United States Patent [19]

Andersen

[11] Patent Number: 4,489,901

[45] Date of Patent: Dec. 25, 1984

[54] COIL WINDING APPARATUS

[75] Inventor: Poul Andersen, Wallingford, Conn.

[73] Assignee: Allegheny Ludlum Steel Corporation, Pittsburgh, Pa.

[21] Appl. No.: 495,369

[22] Filed: May 17, 1983

[51] Int. Cl.[3] ..... B65H 17/20; B65H 57/28

[52] U.S. Cl. ..... 242/67.2; 242/158 R; 242/DIG. 2

[58] Field of Search ..... 242/157.1, 158 R, DIG. 2, 242/67.1 R, 67.2

[56] References Cited

U.S. PATENT DOCUMENTS

| | | | |
|---|---|---|---|
| 736,472 | 8/1903 | Anderson . | |
| 1,764,618 | 6/1930 | Franks | 242/158 R |
| 2,135,668 | 11/1938 | Judelshon | 242/DIG. 2 X |
| 2,228,346 | 1/1941 | Downie | 254/190 |
| 2,336,684 | 12/1943 | Hendrickson | 242/157.1 |
| 2,473,628 | 6/1944 | Allison | 254/190 |
| 2,478,454 | 8/1949 | Bosh | 242/158 R |
| 3,589,642 | 6/1971 | Biagg | 254/190 |
| 3,963,186 | 6/1976 | Van den Aa | 242/158 R |
| 4,232,838 | 11/1980 | Bravin | 242/157.1 |

*Primary Examiner*—Stuart S. Levy
*Assistant Examiner*—Joseph J. Hail, III
*Attorney, Agent, or Firm*—Patrick J. Viccaro

[57] ABSTRACT

An apparatus is provided for winding a continuous, flat strip onto a winding reel to form successive, abutting convolutions along the reel in multiple, flat layers to form a tight coil of strip, which strip may typically be an alloy such as stainless steel. The apparatus includes a winding reel fixedly mounted and having means for imparting axial rotation to continuously wind said strip onto the reel, a guide roll for guiding the strip onto the reel with the guide roll having means for laterally moving it along the axial dimension of the winding reel to form the successive abutting convolutions of strip over the surface of the reel and two movable bridle wheels mounted on generally parallel axes for defining a path of travel for the strip around the bridle wheels and to the guide roll. The guide roll and the bridle wheels are mounted to a common movable frame which may be tilted to tilt the bridle wheels and simultaneously laterally move the guide roll while maintaining substantial and continuous longitudinal alignment between the strip leaving the bridle wheels and the guide roll so that the strip follows a straight path from the bridle wheels under the guide roll and onto the winding reel. Lateral motion is imparted to the strip without any permanent distortion, such as camber, introduced to the strip; however, there is no lateral motion of the strip relative to the guide roll and movable bridle wheels as the strip is wound about the winding reel.

7 Claims, 1 Drawing Figure

COIL WINDING APPARATUS

BACKGROUND OF THE INVENTION

This invention relates to an apparatus for oscillate winding strip into coils. More particularly, this invention relates to an apparatus for oscillate winding narrow strip onto a fixedly mounted and rotating winding reel by imparting lateral motion to the strip without permanently distorting the strip.

Incident to the manufacture of narrow strip, such as stainless steel, it is customary to oscillate wind the strip into coils to accommodate the maximum strip length in a single wound coil. Stainless steel strip of this character may be in strip widths as narrow as 3/16 inch (4.7 mm). The strip is typically wound onto a reel to form successive, abutting convolutions along the length of the reel in multiple layers. The coil so wound must be sufficiently tight to permit transport and handling.

Apparatus presently used for this purpose embodies a winding reel adapted for lateral movement during the winding operation to form the successive strip convolutions along the surface of the reel. A fixed guide roll is provided to guide the strip onto the winding reel. As the coil is formed successively on the winding reel, it is necessary to have equipment that produces lateral oscillation of the reel capable of handling up to the maximum weight of the finally wound coil. Conventionally, the practical weight limit for a coil is approximately 2000 lbs. because heavier coils cannot be oscillated with the equipment presently available.

To overcome this problem, it has been proposed to maintain the winding reel fixed and oscillate the guide roll laterally and axially to avoid the problem of providing for oscillation of the winding reel and coil formed thereon. It has been found, however, that when lateral movement is imparted to the guide roll alone, this lateral motion, which is likewise transmitted to the strip, causes a continuous and variable camber in the strip. This camber is permanent and is detrimental to subsequent processing operations for it requires straightening prior to the strip being further processed, for example, forming and stamping, for many of its intended purposes.

SUMMARY OF THE INVENTION

In accordance with the present invention, an apparatus is provided for oscillate winding a continuous flat strip without permanently distorting the strip. Generally stated, the invention contemplates an apparatus for winding a continuous, flat strip onto a fixedly mounted winding reel to form successive, abutting convolutions along the winding reel in multiple, flat layers to form a tight coil of strip. The apparatus includes means for axially rotating the reel to continuously wind the strip onto the reel, means for guiding the strip onto the reel, means for laterally moving the guide means generally axially with respect to the reel, and two movable bridle wheels mounted for rotation on generally parallel axes and defining a path of travel for the strip around the movable bridle wheels and to the guide means. The apparatus includes a means for simultaneously moving the bridle wheels and guide means so that the strip leaving the bridle wheels is in substantial and continuous longitudinal alignment with the guide means during the lateral movement of the guide means.

It is, accordingly, a primary object of the present invention to provide a coil winding apparatus wherein the winding reel may be fixed for rotation, thus eliminating the need for lateral oscillating movement of the winding reel and coil formed thereon, without imparting any lateral movement to the strip as it is fed to the guide roll and from the guide roll to the winding reel.

This and other objects of the invention, as well as a more complete understanding thereof, may be obtained from the following description and drawing.

DETAILED DESCRIPTION OF THE PREFERRED EMBODIMENTS

Figure 1:
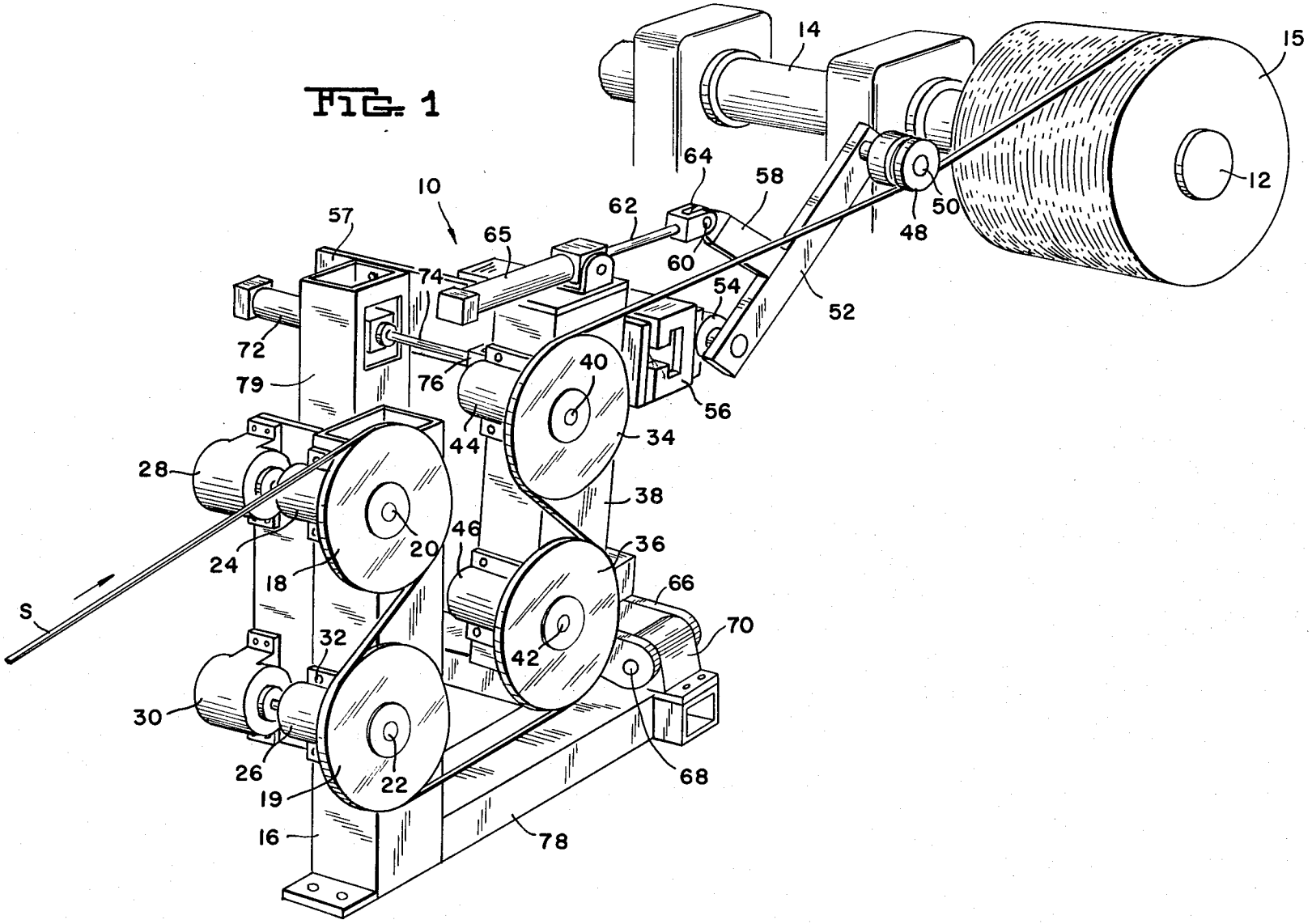
FIG. 1 is a perspective view of one embodiment of apparatus in accordance with the present invention.

Broadly, the present invention is in an apparatus for winding a continuous, flat strip, such as stainless steel, onto a winding reel to form successive, abutting convolutions along the winding reel in multiple, flat layers to result in a tight coil of the strip. The apparatus of the invention involves a winding reel that is fixedly mounted and has means associated therewith for imparting axial rotation of the winding reel to continuously wind the strip onto the reel in the conventional manner. Means in the form of a guide roll is provided for guiding the strip onto the reel and the guide roll is provided with means for laterally moving it generally axially. This lateral movement permits the guide roll to oscillate along the axial length of the winding reel and thereby guide the strip onto the reel to form the successive convolutions of strip along the surface of the reel constituting the coil. Two movable bridle wheels are mounted for rotation on generally parallel axes and define a path of travel for the strip around the movable bridle wheels and to the guide roll. The guide roll and the movable bridle wheels are commonly mounted on a movable frame and means are provided for moving the frame which is journaled so that upon movement the bridle wheels tilt axially and unitarily while maintaining their axes generally parallel and simultaneously therewith lateral movement is imparted to the guide roll so that the strip leaving the bridle wheels follows a straight, longitudinal path from the bridle wheels, under the guide roll and onto the winding reel. In this manner, there is no lateral movement imparted to the strip through the bridle wheels and thus it forms a coil without any permanent distortion of the strip. Lateral movement of the guide roll is permitted by connection to a linear slide so that as the bridle wheels are tilted axially upon movement of the frame, the guide roll slides linearly and on an axis parallel with respect to the axis of the winding reel. The strip is fed to the movable bridle wheels from an identical pair of fixed bridle wheels which are mounted on axes parallel with those of the movable bridle wheels. Upon the unitary tilting of the movable bridle wheels, the strip fed thereto from the fixed bridle wheels is subjected to a twisting action about the longitudinal axes of the strip but is not subjected to any lateral movement. If this twisting of the strip is within a limit of a maximum of $\pm 15°$, and preferably $\pm 10°$, depending upon the material from which the strip is manufactured, it has been found that such will not result in any permanent distortion as is the case with only lateral movement of the strip. Consequently, with the apparatus of the invention, the winding reel may be maintained stationary with the required lateral movement for winding the coil over the surface of the winding reel being provided by the guide roll without, however, imparting any lateral movement to the strip as it passes through the bridle rolls and under the guide roll.

With reference to the drawings, and for the present FIG. 1 thereof, there is shown one embodiment of a coil winding apparatus in accordance with the present invention and designated generally as 10. The apparatus comprises a winding reel 12 having a drive shaft 14 which may be connected in the conventional manner to a pulley drive (not shown) adapted in the conventional manner to rotate the winding reel 12 and coil 15 thereon. The apparatus further includes a fixed frame 16 onto which fixed bridle wheels 18 and 19 are mounted. The bridle wheels 18 and 19 are mounted for rotation on shafts 20 and 22, respectively, which are journaled in bearing housings 24 and 26, respectively, and are driven by motors 28 and 30, respectively. The bearing housing 24 and 26 are bolted to frame 16 by bolts 32. Similarly constructed movable bridle wheels 34 and 36 are similarly mounted to a movable frame 38. The movable bridle wheels 34 and 35 are mounted for rotation on shafts 40 and 42, respectively, which are journaled in bearing housings 44 and 46, respectively. Unlike the fixed bridle wheels 18 and 19, the movable bridle wheels 34 and 36 are not driven. The fixed bridle wheels 18 and 19 and the movable bridle wheels 34 and 36 may be located on the same vertical plane. The axes of rotation about the respective shafts of wheels 18 and 34 may be located on a horizontal plane, which is parallel to a horizontal plane in which the axes of wheels 19 and 36 lie.

Also connected to movable frame 38 is a guide roll 48. Guide roll 48 is mounted for rotation on shaft 50 which is connected to swinging tension arm 52 which is rotatably secured by bearing 54 to roller slide 56, which also is connected to movable frame 38 through a suitable linkage, such as a double ball joint and movably secured to slide track 57.

Slide track 57 is rigidly attached to upright frame part 79 of base 78 by means of bolts or similar fastening.

Also, as shown in FIG. 1, tension arm 52 through bracket 58 is attached by pin 60 to piston rod 62 by bifurcated connector 64; piston rod 62 is associated with air cylinder 65, which arrangement provides for the proper tension control to the guide roll 48.

The frame 38 through bracket 66 is rotatably connected by shaft 68 to bearing housing 70. Connected to the frame 38 is hydraulic cylinder 72 having a piston rod 74 attached by rotatable bifurcated mounting 76 to the frame 38 as by welding, and a rotatable mounting attached to upright frame part 79 of base 78. The assembly constituting the hydraulic cylinder 72, piston rod 74 and bifurcated mounting 76 permits the tilting of the frame 38 and associated bridle wheels 34 and 36 about shaft 68 journaled in bearing housing 70. Preferably, shaft 68 in bearing housing 70 is located with its centerline tangential to the lower portion of bridle wheel 36. As shown in FIG. 1, bearing housing 70 is bolted to base 78.

In the operation of the apparatus, strip, which may be stainless steel and designated in the drawing as S, moves in the direction of the arrow through the apparatus 10 of the invention and onto the winding reel 12. The strip passes through the fixed bridle wheels 18 and 19, then through the movable bridle wheels 34 and 36, finally under the guide roll 48 and onto the coil 15 of winding reel 12. Motors 28 and 30 provide through bridle wheels 18 and 19, respectively the required drive and/or back tension to the strip passing through the apparatus. To permit the strip being introduced to the reel 12 and, consequently, coil 15 to traverse the same axially along the surface of the reel to form the desired series of successive, abutting convolutions thereon to form the coil 15, the frame 38 and associated guide wheels 34 and 36 are tilted in oscillating fashion by pivoting about shaft 68 in bearing housing 70. Likewise, during tilting of the frame 38 the guide roll 48, by the action of roller slide 56, moves laterally and linearly relative to the axis of the reel 12. Tilting of the frame 38 is provided by the action of hydraulic cylinder 72 and associated piston rod 74 which is rotatably connected to the frame 38 by the rotatable bifurcated mounting 76. The control of cylinder 72 and correspondingly the movement imparted to the guide roll 48 and bridle wheels 34 and 36 may in the conventional manner be controlled through a hydraulic servo system operated by an electronic control. In the conventional manner, a pulse generator coupled to the reel 12 and a linear potentiometer coupled to the roller slide 56 would provide a feedback control to the hydraulic cylinder 72 to insure the proper tilting action to the frame 38. This system is conventional and does not constitute a part of the present invention; however, one example of a system suitable for the purpose would include a hydraulic cylinder 72 operating the swinging frame assembly and controlled by a hydraulic servo valve. The servo valve is controlled by an electronic package that integrates the signals from a pulse generator connected to reel 12 and a linear potentiometer connected to roller slide 56 in such a fashion that the rotary motion of reel 12 is syncronized with the linear motion of said slide 56 to produce a specified rate of lateral motion of said slide 56 in relation to each revolution of reel 12. The specified rate of lateral motion of slide 56 is adjustable for different strip widths. The linear potentiometer provides the reference of slide 56 location as well as reference of reversal points of same, thus controlling the width of coil 15.

When the frame 38 is tilted as described, the corresponding tilting of bridle wheels 34 and 36 in combination with the sliding action of guide roll 48 will maintain the strip, leaving the bridle wheel 34 longitudinal during its passage under guide roll 48 and onto the reel 12. There will be no lateral motion imparted to the strip relative to wheels 34 and 36 and guide roll 48. The strip leaving the fixed bridle wheel 19 as it passes to bridle wheel 36 will be subjected to a twisting action. So long as this twisting action is not sufficiently drastic to cause permanent deformation of the strip, it will be flat and characterized by absence of camber when applied to the reel 12. With materials such as stainless steel strip and the like having widths on the order of 3/16 to 1 inch (4.7 to 25.4 mm), it has been found that the strip may be twisted about its longitudinal axis to a maximum of about 10° without causing any permanent deformation. The degree of twisting that may be imparted to the strip without causing permanent deformation will, of course, vary for various types of materials and will likewise vary with the width and thickness of the strip.

It may be seen from the above description of the apparatus of the invention that since it is not necessary to oscillate the winding reel, there is no size or weight limit with respect to the coil that may be formed on the reel. As there is no requirement to provide for oscillation of the reel and the coil formed thereon, the equipment required for coil-winding is minimized, particularly from the standpoint of size and power requirements.

While several preferred and alternative embodiments of the invention have been shown and described, it will be apparent to those skilled in the art that modifications may be made therein without departing from the scope of the present invention.

What is claimed is:

1. Apparatus for winding a continuous, flat strip onto a winding reel to form successive, abutting convolutions along the winding reel in multiple, flat layers to form a tight coil of said strip, said apparatus comprising said winding reel being fixedly mounted and having means for imparting axial rotation to said reel to continuously wind said strip onto said reel;

means for guiding said strip onto said reel;

means for laterally moving said guide means generally axially with respect to said reel;

two movable bridle wheels mounted for rotation on generally parallel axes and defining a path of travel for said strip around said movable bridle wheels and to said guide means;

means for simultaneously moving said birdle wheels so that the strip leaving said bridle wheels is in substantial and continuous longitudinal alignment with said guide means during said lateral movement of said guide means;

said guide means and said movable bridle wheels being connected to a common frame and means are provided for moving said frame and associated guide means and movable bridle wheels unitarily; and said frame being journaled so that upon moving of said frame, said movable bridle wheels tilt axially and unitarily while maintaining their axes generally parallel and simultaneously impart lateral movement to said guide means.

2. The apparatus of claim 1 wherein said guide means is a roll under which said strip passes during travel to said winding reel.

3. The apparatus of claim 1 wherein said guide means is connected to a linear slide which permits said lateral movement of said guide means generally axially parallel with respect to said winding reel simultaneously with said tilting of said movable bridle wheels.

4. The apparatus of claim 3 wherein two fixed bridle wheels are journaled for axial rotation on a fixed frame and said bridle wheels define a path of travel for said strip around said fixed bridle wheels and to said movable bridle wheels.

5. The apparatus of claim 4 wherein separate drive means are connected to the two fixed bridle wheels to facilitate threading of the strip and adjustment of the back tension for winding tight coils.

6. Apparatus for winding a continuous, flat strip onto a winding reel to form successive abutting convolutions along the winding reel in multiple, flat layers to form a tight coil of said strip, said apparatus comprising said winding reel being fixedly mounted and having means for imparting axial rotation to said reel to continuously wind said strip onto said reel;

a guide roll under which said strip passes during travel to said winding reel and which guides said strip onto said reel;

a linear slide to which said guide roll is connected which slide permits lateral movement of said guide roll generally axially parallel with respect to said winding reel;

two movable bridle wheels mounted for rotation on generally parallel axes and defining a path of travel for said strip around said movable bridle wheels and to said guide roll;

a movable frame to which said guide roll and movable bridle wheels are connected, said movable frame being journaled so that upon moving of said frame said movable bridle wheels tilt axially and unitarily while maintaining their axes generally parallel and impart simultaneous lateral movement to said guide roll and two fixed bridle wheels journaled for axial rotation on a fixed frame, said fixed bridle wheels defining a path of travel for said strip around said fixed bridle wheels and to said movable bridle wheels.

7. The apparatus of claim 6 wherein said two fixed bridle wheels have generally parallel axes.

* * * * *